US005900080A

United States Patent [19]

Baldi et al.

[11] Patent Number: 5,900,080

[45] **Date of Patent: * May 4, 1999**

[54] THIXOTROPIC FORMING PROCESS FOR WHEELS FASHIONED IN RHEOCAST METAL ALLOY AND FITTED WITH PNEUMATIC TIRES

[75] Inventors: Valter Baldi, Bologna; Gianni Benni, Calderara Di Reno; Giorgio Muneratti, Polesella, all of Italy

[73] Assignee: Reynolds Wheels International. Ltd, Lugano, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/549,094

[22] Filed: Oct. 27, 1995

[30] Foreign Application Priority Data

Nov. 7, 1994 [IT] Italy ..... B094A0484
Jun. 8, 1995 [EP] European Pat. Off. ..... 95830240

[51] Int. Cl.[6] ..... B22D 17/00

[52] U.S. Cl. ..... 148/550; 148/549; 148/550; 148/551; 148/552; 29/527.5

[58] Field of Search ..... 148/549, 550, 148/551, 552; 29/527.5

[56] References Cited

U.S. PATENT DOCUMENTS 4,537,242 8/1985 Pryor et al. ..... 164/460
4,579,604 4/1986 Beyer .

FOREIGN PATENT DOCUMENTS 0 379 453 7/1990 European Pat. Off. .
0 489 503 6/1992 European Pat. Off. .
2026363 7/1979 United Kingdom .
2 026 363 2/1980 United Kingdom .
2172900 10/1986 United Kingdom .

*Primary Examiner*—Patrick Ryan
*Assistant Examiner*—M. Alexandra Elve
*Attorney, Agent, or Firm*—Darby & Darby

[57] ABSTRACT

The starting material in a thixotropic forming process for the manufacture of road wheels, fitted ultimately with pneumatic tyres, is an ingot of rheocast metal alloy preheated to the semisolid state: the ingot is injected into a closed die affording a cavity in the shape of the wheel and equipped with independent thermoregulating circuits routed and controlled in such a way as to maintain the wider passages of the cavity at a temperature lower than that of the narrower passages; to ensure the die fills properly, the ingot is injected at a variable and controlled velocity, correlated both to the rate at which the alloy spreads through the cavity and to the geometry of the cavity itself, whereupon a pressure much higher than the injection force is applied to the solid-semisolid interface within the alloy, and sustained until full solidification is achieved.

21 Claims, 3 Drawing Sheets

17
Sd
13
Si
12
11
B
16
18
2
A
9a
9
10
14
15
Zi
B'
6
A'
3
4
5
7
22

1
20
3
21
25
22
4
X
Y
7
8
19
5
A'
B'
Zd
6

THIXOTROPIC FORMING PROCESS FOR WHEELS FASHIONED IN RHEOCAST METAL ALLOY AND FITTED WITH PNEUMATIC TIRES

BACKGROUND OF THE INVENTION

The present invention relates to a thixotropic forming process suitable for wheels fashioned from rheocast metal alloy in the semisolid state, and in particular for the manufacture of aluminium alloy road wheels fitted ultimately with pneumatic tyres. The shaping processes employed conventionally in the manufacture of road wheels for pneumatic tyres are essentially those of forging, and casting in permanent molds, both of which well known in the wider field of mechanical engineering.

Forging is the familiar process by which a metal alloy can be shaped in the solid state. Employed in the particular context of the art field pertinent to the manufacture of wheels for pneumatic tyres, this is a facility which allows the realization of products with superior mechanical properties, but which at the same time gives rise to a number of drawbacks, namely, the need to use alloys suitable for plastic working, the impossibility of producing articles with geometrically complex shapes, and the fact that the end product will be arrived at only after implementing a series of consecutive steps, especially a product characterized by significant variations in thickness such as are evident in the typical geometry of a road wheel. The high cost of the forging process represents a further drawback. The process of casting in a permanent mold, where an alloy is worked in the liquid state, allows the realization of a product at low cost in relatively few steps, and in this instance even with complex geometries. By contrast, the mechanical quality of the cast product is inferior to that of the forged product, and, moreover, with casting no less than with forging, there is the need to utilize alloys having particular intrinsic properties specifically suited to the technological process in question. More especially, the lower mechanical quality of the cast wheel is attributable to the structural characteristics of casting alloys, as well as to the porosity and discontinuity which are generated within the fabric of the wheel and derive from the particular type of casting process.

In addition, both of the processes mentioned above are characterized in that the forged or cast piece requires generous allowances of material, dictating the need for extensive additional machining steps before the piece can be considered an end product.

Recent times have seen the development of a new technology, namely the thixotropic forming of metal alloys in the semisolid or semiliquid stated; in this instance, the end product is obtained from an ingot or billet exhibiting a particular structure that appears physically homogeneous on macroscopic inspection, but when viewed microscopically appears as a plurality of solid globular granules immersed in a liquid phase. The ingot can take on different characteristics according to the percentages, by weight, of the solid and liquid fractions: in the case of a semisolid, the material can behave in the manner of a solid, for example when conveyed from a heating station to a work station or thixotropic injection forming station, but in the manner of a liquid when injected under pressure.

There are currently no known applications of this new technology in the art field that embraces the manufacture of wheels for pneumatic tyres.

Given that there are clear advantages and drawbacks alike with both the forging process and the casting process conventionally adopted in the manufacture of road wheels, as intimated above, the object of the present invention is to overcome the drawbacks of each such method while combining the advantages.

SUMMARY OF THE INVENTION

The stated object is realized in a thixotropic forming process for the manufacture of road wheels from rheocast metal alloy, in accordance with the present invention.

A typical wheel has sections of greater thickness consisting in a disc and, radiating from the disc, a plurality of spoke ribs alternated with relative voids, also sections of lesser thickness combining to establish a substantially cylindrical lateral surface or rim exhibiting an inner portion and an outer portion and flanged on either side.

The process utilizes ingots of the rheocast metal alloy preheated in order to bring the globular microstructure to a semisolid state, guaranteed uniform throughout the ingot, and comprises the steps of:

injecting the semisolid ingot into a closed die of which the cavity, bearing the shape of the wheel, presents sections of greater width corresponding to the sections of greater thickness exhibited by the wheel, and sections of lesser width corresponding to the sections of lesser thickness exhibited by the wheel, which are proportioned such that the width at least of the section of lesser width, corresponding to the inner portion of the lateral surface, is greater than the width reflecting the definitive or final thickness of the selfsame inner portion;

thermoregulating the die by ensuring a relatively higher temperature at the sections of lesser width exhibited by the cavity and at the same time a relatively lower temperature at the sections of greater width exhibited by the cavity;

simultaneously monitoring and varying the velocity at which the ingot is injected, in such a way as to vary the rate at which the front of semisolid metal alloy advances in the cavity through the dissimilar flow passages afforded by the sections of greater width and the sections of lesser width, until the cavity is completely filled, and in such a manner that the advance of the semisolid front is faster through the sections of greater width;

thereafter, subjecting the metal alloy solidifying internally of the cavity to a pressure greater than the injection pressure, thereby achieving greater compaction of the material within the die;

removing the solidified wheel from the die, then hot-drawing the inner portion of the rim by force of compression to reduce the initial thickness of the selfsame inner portion to a definitive or final thickness.

To particular advantage, the process disclosed can be applied in manufacturing metal alloy wheels even of complex geometry, including slender sections and much broader sections alternating substantially in unlimited manner, and thus incorporates a feature characteristic of the permanent mold type casting techniques mentioned above.

BRIEF DESCRIPTION OF THE DRAWINGS

The invention will now be described in detail, by way of example, with the aid of the accompanying drawings, in which.

DESCRIPTION OF THE PREFERRED EMBODIMENTS

With reference to the accompanying drawings, the invention relates to a process for the manufacture of wheels in rheocast metal alloy, typically road wheels fitted subsequently with pneumatic tyres, which utilizes billets of rheocast aluminium alloy obtained in conventional manner by recasting from pigs of raw stock having a dendritic structure. The liquid alloy is directed through a filter and into a casting device equipped with an agitator and a chill, whereupon the cooling material solidifies and is formed into billets exhibiting a rheocast microstructure. The billets are then divided into ingots 1 of predetermined weight, which undergo controlled heating at a temperature within the solidification range of the alloy and are brought to a thixotropic semisolid state characterized by a microstructure (indicated in FIG. 1*a*) that comprises a liquid phase 14, resulting from the components of the alloy having a lower melting point, and a mass of substantially rounded solid granules 15 immersed in the liquid.

Figures 1, 1A, 1B, 1C:
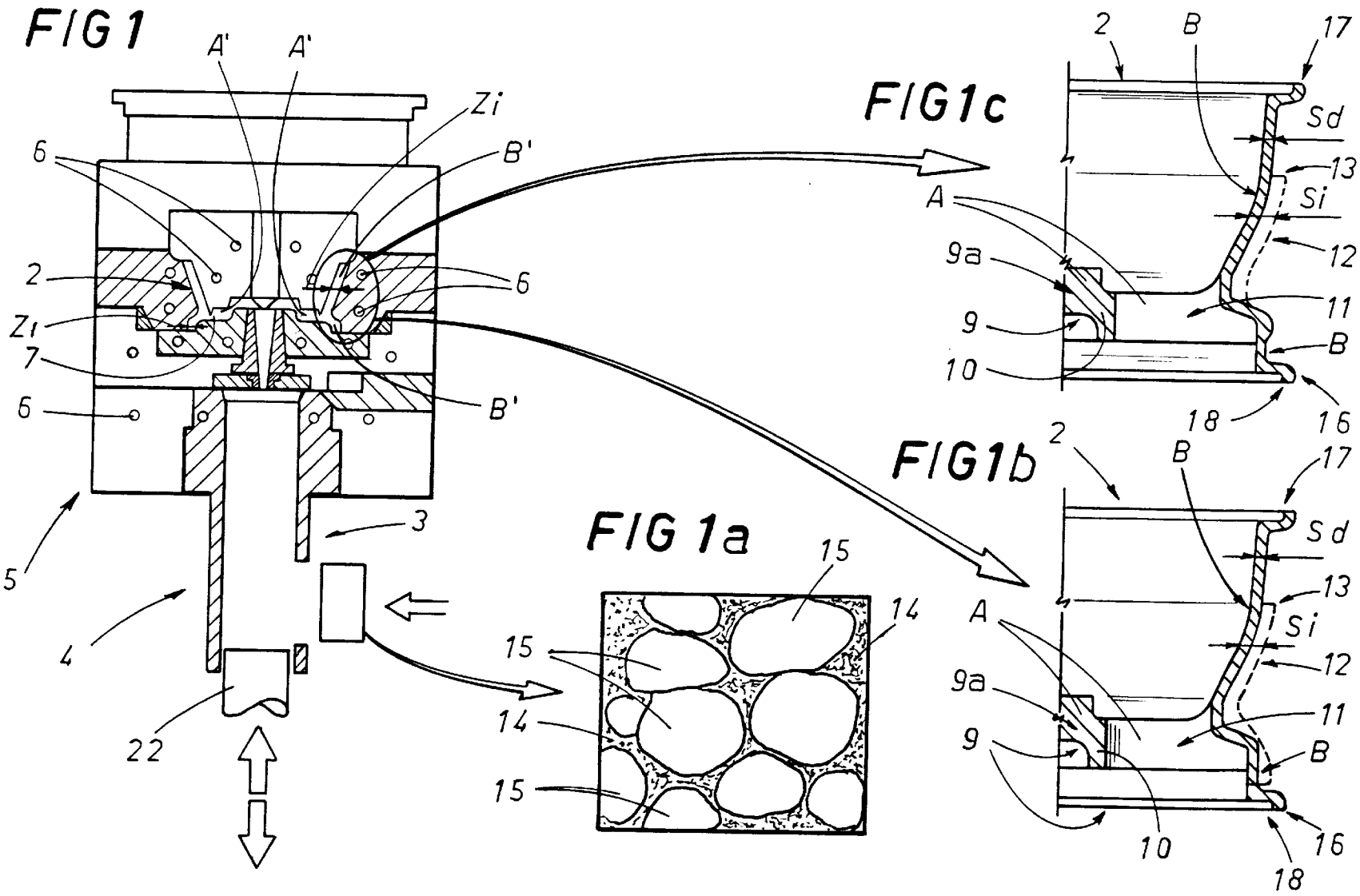
FIGS. 1, 1*a*, 1*b* and 1*c* schematically illustrate the succession of steps making up a complete cycle in the manufacture of wheels for pneumatic tyres utilizing the thixotropic forming process according to the present invention.
Figure 2:
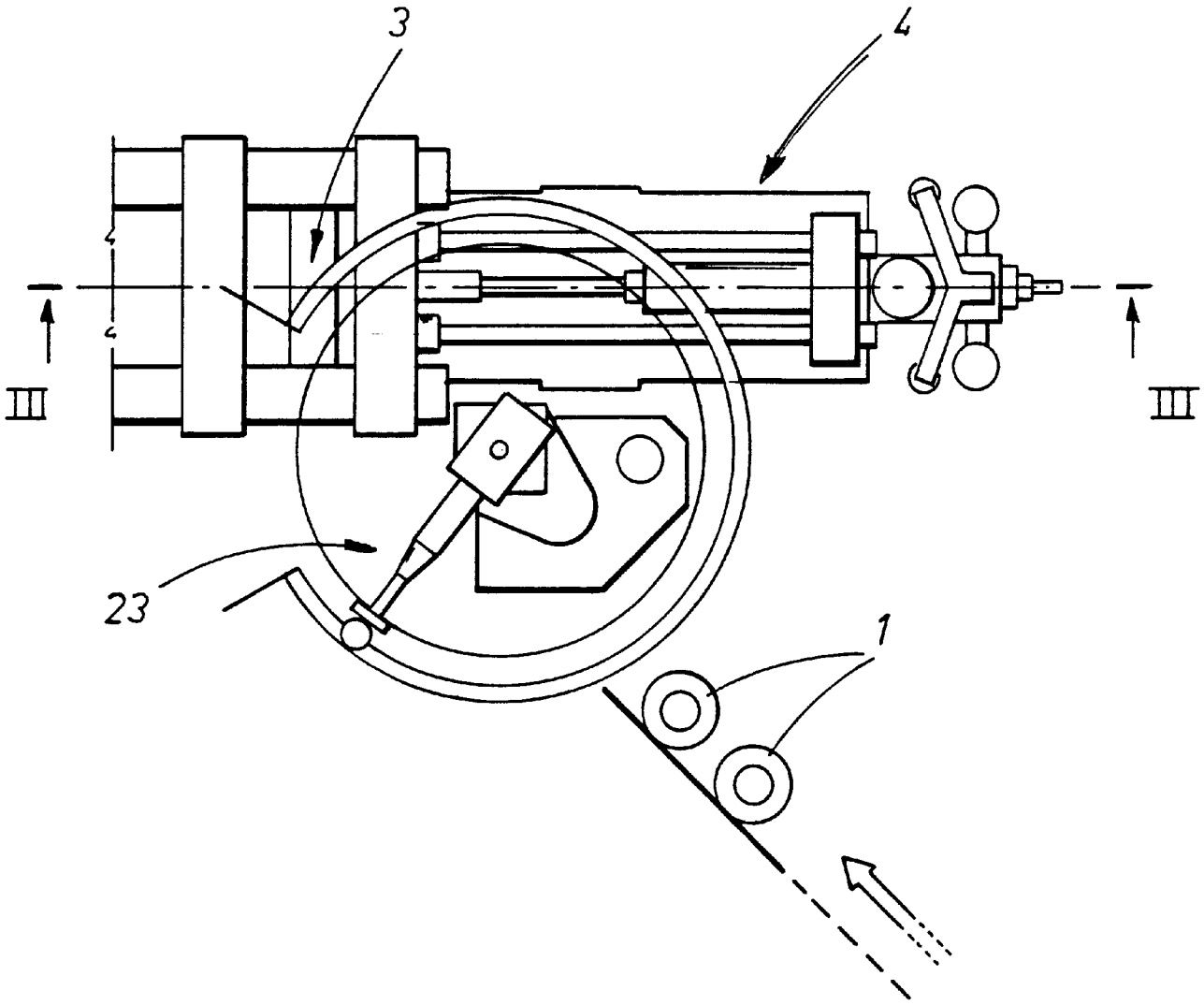
FIG. 2 is the schematic illustration of a machine designed to implement the process according to the invention, viewed in plan.

The ingots 1 are uplifted in this same semisolid state, for example by automatic handling means 23 (as indicated in FIG. 2) and introduced singly into the injection chamber 3 of a thixotropic injection forming machine 4 (FIGS. 1, 2 and 3) operating in conjunction with a closed die or mold 5 by which the wheel 2 is effectively given its shape.

Figures 3, 4:
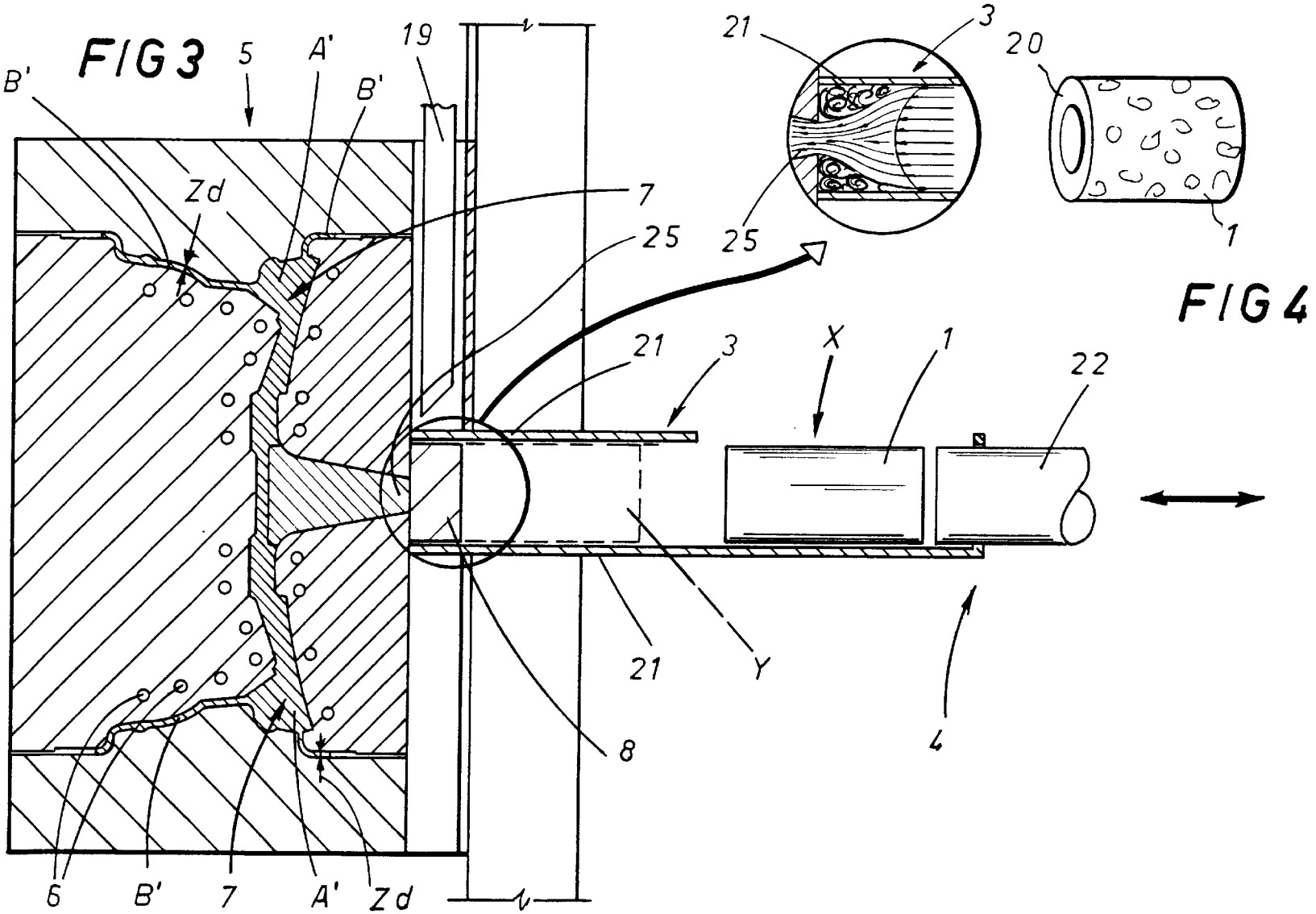
FIG. 3 illustrates the machine of FIG. 2 partly in section through III—III, seen with certain parts omitted better to reveal others.
FIG. 4 illustrates a detail of FIG. 3 relative to the injection step of the process according to the invention.

As discernible in FIGS. 1 and 3, the die 5 affords a cavity 7 of shape substantially matching that of the wheel 2 and is provided with thermoregulating circuits 6 carrying a hot fluid, oil for example, supplied by a unit not shown in the drawings. The injection chamber accommodates a ram 22 that can be reciprocated at a variable rate by the thixotropic injection forming machine 4 (described more fully in due course).

The thermoregulating circuits 6, which run adjacent to the die cavity 7, are mutually independent and arranged in such a way that sections A' of greater width exhibited by the cavity 7 can be cooled, or more exactly heated to a lower temperature, whilst sections B' of lesser width are heated to higher temperature. The term "width" is used to indicate the transverse dimensions of the space afforded by the relative passage of the cavity 7.

The features in question are intended to ensure the die 5 is filled completely and uniformly, as will emerge from the specification in due course.

Given the typically variable geometry of wheels for pneumatic tyres, and given the alternation between sections B of lesser thickness and sections A of greater and accentuated thickness, the operation of filling the die 5 with the alloy in its semisolid state is a particularly critical one. A complete fill is in fact made possible only by ensuring that the liquid phase of the semisolid alloy (which in any event is proportionally less than the solid) does not solidify within the sections B' of lesser width and thus block the passage afforded to the semisolid material entering the cavity 7, forced in by the ram 22, before the part of the die 5 beyond the blockage has been filled to capacity. In other words, it is essential that the interface between the solidifying alloy and the liquid phase of the injected semisolid mass should progress regularly, advancing internally of the die cavity 7 from the peripheral parts of the wheel 2 back to the areas nearer the injection chamber 3.

In accordance with the present invention, wheels for pneumatic tyres are manufactured from rheocast metal alloy employing a thixotropic forming process in which use is made of ingots 1 already preheated to the point of bringing the alloy to the uniform semisolid state described above.

Before describing the process further, it should be remarked that the aforesaid sections A of greater thickness exhibited by the typical wheel 2 consist in a central disc 9 incorporating a hub 9*a*, and a plurality of spoke ribs 10 radiating from the hub in alternation with respective voids 11. The same wheel also presents sections B of lesser thickness consisting in a lateral cylindrical surface 12 or rim composed of an inner portion 13 and an outer portion 16. The two portions are compassed in turn by an inside flange 17 and an outside flange 18. The process comprises a step of injecting the metal alloy ingot 1, in the semisolid thixotropic state, into the cavity 7 of the die 5.

In a die designed to produce a first embodiment of the wheel 2, as illustrated in FIGS. 1 and 1*c*, the width Zi at least of the narrower section B' of the cavity 7, which corresponds to the inner portion 13 of the rim 12, is greater than the width Zd that will determine the definitive or final shape of the inner portion 13. Accordingly, the thickness Si of this same portion 13 on completion of the injection step will be greater than the final thickness Sd to be obtained on completion of the process overall.

During the injection step of the process, a step of thermoregulating the die 5 is implemented by way of the relative circuits 6 which, to reiterate, are able to maintain a relatively higher temperature in the cavity 7 at the sections B' of lesser width and at the same time a relatively lower temperature at the sections A' of greater width.

Likewise during the injection step, the velocity at which the ingot 1 is forced into the die will be monitored and varied by monitoring and varying the linear velocity of the ram 22, and thus controlling the rate at which the front of metal alloy advances in the semisolid state internally of the cavity 7. The injection rate is a function of the dissimilar flow passages afforded by the wider and narrower sections A' and B' of the cavity 7, and continues to be controlled until the die has filled, thereby allowing a faster advance of the front of semisolid alloy through the wider areas A' of the cavity 7 and a slower advance through the narrower areas B'. Accordingly, the movement of the thixotropic alloy internally of the cavity 7 is made laminar as far as possible.

In order to optimize the compaction of the metal alloy within the cavity 7 following the injection step and during solidification, the material is subjected to an additional pressure force, applied through the ram 22 by the thixotropic injection forming machine 4, compounding and therefore much greater than the injection pressure force applied previously. Solidification is followed by the steps of removing the wheel 2 from the die 5 and then hot-drawing the inner portion 13 of the rim 12 by compression. The purpose of the drawing operation is to reduce the inner portion 13 from the initial injection forming thickness Si, indicated in FIG. 1*c* by phantom lines, down to the definitive or final thickness Sd. Moreover, this step has the effect of achieving increased mechanical strength, at least across the inner portion 13 of the rim 12, and of compacting the metal alloy still further so as to avoid the eventuality, should the finishing steps of manufacture involve the removal of material by machining, that interstices could then appear in the structure and jeopardize the airtightness of the wheel when fitted ultimately with a pneumatic tyre.

In another solution illustrated in FIGS. 1 and 1*b*, both of the narrow sections B' exhibited by the die cavity 7, which generate the lateral surface 12 of the wheel 2, are proportioned to a width Zi greater than the definitive or final width Zd, as described already with reference to FIG. 1*c*. With the wheel 2 removed from the die in this instance, therefore, it is the entire lateral surface 12 that will be hot-drawn by compression to the end of reducing the initial thickness Si to the definitive or final thickness Sd, as in the previous example.

In a further solution illustrated in FIG. 3, the selfsame thixotropic forming process is implemented using a closed die 5 with a cavity 7 of geometry, sectional profile and dimensions identical to the final geometry, sectional profile and dimensions of the wheel 2. In this instance, no drawing operation is performed on the wheel 2 once removed from the die 5.

With regard to the step of preheating the alloy, the process allows for the application of a heat treatment whereby the ingots 1, initially in the solid state, are immersed in convectional flows of hot air for a period of time and at a temperature sufficient to bring the alloy to the thixotropic semisolid state.

For the reasons mentioned previously, the step of injecting the semisolid ingots 1 is implemented generally at low velocity so that laminar flow can be induced in the thixotropic alloy; in addition, the velocity is varied cyclically so as to ensure a uniform progression of the solidification interface aforementioned.

As discernible from FIG. 3, the ingot 1 is advanced by the ram 22 of the injection forming machine 4 from a first position X of introduction into the injection chamber 3, to a second position Y from which the material is forced into the die 5. In passing from position X to position Y, the ingot 1 is forced at minimal velocity so that air will not be trapped between the ingot 1 and the wall 21 of the chamber 3 and allowed thus to find its way into the die cavity 7 at the next injection.

Solidification of the liquid phase in the semisolid alloy represents a critical aspect of the process disclosed, as already explained. Nonetheless, as long the rheocast alloy introduced into the die cavity 7 has a solid content of some 50 or 60%, this ensures advantageously that contractions and thermal shocks will be of a limited order.

As stated at the outset, the ingots 1 utilized are of a predetermined weight. More exactly, the weight of the ingot is selected to ensure a quantity of the alloy greater than can be contained within the die cavity 7, so that on completion of the step in which the ingot 1 is injected into the cavity 7, a residual portion 8 of semisolid material is left to solidify externally of the die 5, between the die and the injection chamber 3 (see FIG. 3).

This deliberately generated residual portion 8 of the ingot is instrumental in achieving homogeneity and quality of the wheel. More exactly, the inlet of the die 5 presents a restricted section 25 to the ingot 1 passing from the injection chamber 3 to the cavity 7, of which the effect is to gather up the skin 20 of the ingot, physically and chemically distressed by the intense oxidizing action of the air especially on the liquid phase of the rheocast material, when forced from the injection chamber 3 (see FIG. 4).

Following the injection and solidification of the alloy, the residual portion 8 of the ingot 1 must be cut off, and accordingly, the process includes a shearing step effected by a blade 19, which will be operated after the injection chamber 3 is distanced from the die 5.

A wheel of the type described above can be obtained substantially in a single operation, and, unlike other comparable cast alloy road wheels, betrays no problems of porosity thanks to the viscosity of the semisolid alloy, the variable rate of injection and the advantages of the subsequent hot-drawing step; the wheel described and illustrated also benefits from closer dimensional tolerances due to the fact that solid contractions, affecting only the liquid fraction of the semisolid alloy, are compensated by the application of high pressure forces within the solid-liquid interface, with the result that fewer machining operations are required. In addition, the process disclosed might comprise the further step of heat treating the wheel 2 after its removal from the die 5, and after the step of hot-drawing the rim 12 by compression, if included. This would be a heat treatment designed to induce solid solution in the thixotropic metal alloy from which the wheel is fashioned.

Following heat treatment, the wheel 2 will be age hardened to the end of preventing precipitation in the alloy. Thereafter, the wheel can be machined to remove surface material from the rim 12, and more exactly, to remove the machining allowance left by the earlier compression hot-drawing step performed on the inner portion 13, and possibly on the outer portion 16, of the lateral surface 12.

A wheel produced by the process according to the present invention possesses the premium mechanical properties typical of the forged product, and is also superior in quality to the cast product, thus further improving the resistance to fatigue and the tenacity of the alloy road wheel, and enhancing its appearance.

A further characteristic of any wheel obtained by means of the process disclosed is the especially homogeneous structure of the material from which the wheel itself is fashioned.

What is claimed:

1. A thixotropic forming process utilizing metal alloy ingots for forming wheel hubs of rheocast metal alloy including a disc section, and sections of lesser thickness of a substantially cylindrical lateral surface of a rim having an inside flange and an outside flange, comprising the steps of:

injecting a metal alloy ingot while in a semisolid thixotropic state with an injection pressure force into a die whose cavity has the shape of the wheel hub with a section of greater width corresponding to a wheel hub section of greater thickness and a section of lesser width corresponding to a wheel hub section of lesser thickness proportioned such that the width at least of the die section of lesser width corresponding to the inside flange is greater than the width that will establish the final thickness of said inside flange;

thermoregulating the die by maintaining a relatively higher temperature at the cavity section of lesser width and simultaneously maintaining a relatively lower temperature at the cavity section of greater width thereby to heat the semisolid metal alloy ingot at a relatively higher temperature and decrease the alloy viscosity when flowing in said cavity section of lesser width and to heat the semisolid metal alloy at a relatively lower temperature in said cavity section of greater width and decrease the alloy viscosity when flowing in said cavity section of greater width; and varying the velocity at which the ingot is injected to control the rate at which the leading part of the metal alloy in the semisolid state advances within the cavity according to the different cavity sections of greater and lesser width until the die cavity is completely filled and in such a manner that the semisolid ingot leading part advances at a slower rate through a cavity section of lesser width and at a faster rate through a cavity section of greater widths the combination of thermoregulating and varying the velocity providing the semisolid alloy ingot with a more substantially laminar flow in the die.

2. A process as in claim 1 further comprising the step of subjecting the injected metal alloy solidifying within the cavity to a pressure force greater than the injection pressure force to compact the material internally of the die.

3. A process as in claim 2 further comprising the step of removing the wheel obtained by the preceding steps from the die cavity, and hot-drawing the inner flange by compression to reduce the initial thickness to a final thickness.

4. A process as in claim 1, wherein the ingot is of volume and mass greater that the volume and mass of the quantity of alloy that can be accommodated within the die cavity, and further comprising terminating the injection step before the complete running of the entire ingot mass into the die cavity so that a residual portion containing the skin of the preheated ingot, gathered and retained internally of an injection chamber from which the ingot is fed, is left to solidify in an intermediate position between the inlet of the die and the injection chamber;

cutting off on the solidified residual portion; and removing the formed wheel hub from the cavity of the die.

5. A process as in claim 1 wherein the die cavity is proportioned with the width of the sections of lesser width corresponding to the rim lateral surface being greater than the width of the final thickness of both the rim inner and outer flanges, and further comprising the step of:

removing the formed wheel hub from the die; and hot-drawing the lateral surface by compression to reduce the inner flange and the outer flange to their respective final thicknesses.

6. A process as in claim 1, wherein the step of thermoregulating the die comprises:

circulating a heating fluid in a plurality of thermoregulating circuits disposed peripherally in relation to the die cavity.

7. A process as in claim 6 wherein the step of thermoregulating further comprises circulating a heating fluid in an injection chamber from which the ingots are fed into the cavity.

8. A process as in claim 1 further comprising preheating a metal alloy ingot to bring the globular metallic microstructure of the rheocast alloy to a semisolid state.

9. A process as in claim 8 wherein the preheating step comprises heat treatment of the metal alloy ingots in the solid state by exposure to convectional flows of hot air for a period of time and at a temperature sufficient to bring the alloy to the thixotropic semisolid state.

10. A process as in claim 1, wherein the thixotropic metal alloy ingots are composed, when in the semisolid state, of a solid phase proportioned to constitute between 50 and 60% and a liquid phase proportioned to constitute the remaining 50 to 40%.

11. A process as in claim 3, wherein the step of hot drawing at least the inner flange of the rim lateral surface is by compressing the inner flange, and further comprising the step of heat-treatment of the wheel by a solution.

12. A process as in claim 11, wherein the solution heat-treatment step is followed by a hardening step.

13. A process as in claim 11, wherein the step of hot drawing at least the inner flange of the rim lateral surface is followed by a machining step to eliminate unwanted material left from the previous steps of forming the wheel hub.

14. A process as in claim 12, wherein the step of hot drawing at least the inner flange of the rim lateral surface is followed by a machining step to eliminate unwanted material left from the previous steps of forming the wheel hub.

15. A thixotropic forming process utilizing metal alloy ingots for forming wheels of rheocast metal alloy and including a disc section, and sections of lesser thickness of a substantially cylindrical lateral surface of a rim having an inside flange and an outside flange, comprising the steps of:

injecting a metal alloy ingot while in a semisolid thixotropic state with an injection pressure force into a die whose cavity has the shape of the wheel with a section of greater width corresponding to a wheel hub section of greater thickness and a section of lesser width corresponding to a wheel hub section of lesser thickness, the geometry, sectional profile and dimensions of said cavity being substantially the same as the geometry, sectional profile and dimensions of the finished wheel hub;

thermoregulating the die by maintaining a relatively higher temperature at the cavity section of lesser width and simultaneously maintaining a relatively lower temperature at the cavity section of greater width, thereby to heat the semisolid metal alloy ingot at a relatively higher temperature and decrease the alloy viscosity when flowing in said cavity section of lesser width and to heat the semisolid metal alloy at a relatively lower temperature in said cavity section of greater width-and decrease the alloy viscosity when flowing in said cavity section of greater width;

varying the velocity at which the ingot is injected to control the rate at which the leading part of the metal alloy ingot in the semisolid state advances within the cavity according to the different cavity sections of greater and lesser width until the cavity is completely filled and in such a manner that the semisolid ingot leading part advances at a slower rate through a die cavity section of lesser width and advances at a faster rate through the die cavity section of greater width, the combination of thermoregulating and varying the velocity providing the semisolid alloy ingot with a more substantially laminar flow in the die; and subjecting the injected metal alloy solidifying within the cavity to a pressure force greater than the injection pressure force to compact the material internally of the die.

16. A process as in claim 15, wherein the ingot is of volume and mass greater that the volume and mass of the quantity of alloy that can be accommodated within the die cavity, and further comprising the steps of:

terminating the injection step before the complete running of the entire ingot mass into the die cavity so that a residual portion containing the skin of the preheated ingot, gathered and retained internally of a chamber from which the material is injected is left to solidify in an intermediate position between the die inlet and the injection chamber;

cutting off on the solidified residual portion; and removing the formed wheel hub from the die cavity.

17. A process as in claim 15, wherein the step of thermoregulating the die comprises:

circulating a heating fluid in a plurality of thermoregulating circuits disposed peripherally in relation to the die cavity.

18. A process as in claim 17 wherein the step of thermoregulating further comprises circulating a heating fluid in an injection chamber from which the ingots are supplied to the cavity.

19. A process as in claim 15 further comprising preheating a metal alloy ingot to bring the globular metallic microstructure of the rheocast alloy to a semisolid state.

20. A process as in claim 15 wherein the preheating step comprises heat treatment of metal alloy ingots in the solid state by exposure to convectional flows of hot air for a period of time and at a temperature sufficient to bring the alloy to the thixotropic semisolid state.

21. A process as in claim 15, wherein the thixotropic metal alloy ingots are composed, when in the semisolid state, of a solid phase proportioned to constitute between 50 and 60% and a liquid phase proportioned to constitute the remaining 50 to 40%.

* * * * *

UNITED STATES PATENT AND TRADEMARK OFFICE

CERTIFICATE OF CORRECTION

PATENT NO. : 5,900,080

DATED : May 4, 1999

INVENTOR(S) : Valter BALDI

It is certified that error appears in the above-identified patent and that said Letters Patent is hereby corrected as shown below: On the title page: Item [54] and Column 1, line 4, Title of Invention, change "TIRES" to --TYRES--.

Signed and Sealed this

First Day of February, 2000

*Attest:*

Q. TODD DICKINSON

*Attesting Officer*

*Acting Commissioner of Patents and Trademarks*